United States Patent [19]

Denier et al.

[11] Patent Number: 4,825,884

[45] Date of Patent: May 2, 1989

[54] PROCESS FOR FORMING FLAVOR COMPOUNDS IN TOBACCO

[75] Inventors: Robert F. Denier; Elmer F. Litzinger; Ezra D. Alford, all of Louisville, Ky.

[73] Assignee: Brown & Williamson Tobacco Corporation, Louisville, Ky.

[21] Appl. No.: 104,144

[22] Filed: Oct. 5, 1987

Related U.S. Application Data

[63] Continuation-in-part of Ser. No. 832,551, Feb. 24, 1986, Pat. No. 4,744,375.

[51] Int. Cl.[4] ..... A24B 15/28; A24B 3/12

[52] U.S. Cl. ..... 131/309; 131/310; 131/276

[58] Field of Search ..... 131/309, 300, 301, 302, 131/303, 276, 310

[56] References Cited

U.S. PATENT DOCUMENTS 4,607,646 8/1986 Lilly et al. ..... 131/309
4,638,816 1/1987 Cox et al. ..... 131/276

*Primary Examiner*—V. Millin
*Attorney, Agent, or Firm*—Charles G. Lamb

[57] ABSTRACT

A tobacco treating process for forming favorable flavor compounds in a moisturized tobacco including the steps of contacting the tobacco with citrus pectin, invert sugar, or diammonium phosphate, or a combination resulting in a tobacco having a pectin level and diammonium phosphate level of predetermined percentages, thereof, introducing the moistened tobacco into a containing zone; introducing an ammonia source into the containing zone; heating the contained zone when substantially closed to bring the tobacco to a preselected temperature to improve flavor compounds through reaction of the ammonia source, citrus pectin, and reducing sugars, and/or other tobacco components; and cooling and removing the tobacco from the closed zone.

24 Claims, 1 Drawing Sheet

PROCESS FOR FORMING FLAVOR COMPOUNDS IN TOBACCO

CROSS-REFERENCE TO RELATED PATENTS

This patent application is a continuation-in-part of patent application Ser. No. 832,551, dated Feb. 24, 1986 now U.S. Pat. No. 4,744,375.

BACKGROUND OF THE INVENTION (1) Field of the Invention

The invention relates to tobacco treating processes and more particularly to a process of forming favorable flavor compounds in a moisturized tobacco.

(2) Description of the Prior Art

It is generally well known in the tobacco processing art to use an alkali and steam as a means of removing nicotine from tobacco. For example, long expired U.S. Pat. No. 896,124, issued to G. B. Lindenberger, et al, on Aug. 18, 1908, teaches applying a caustic soda to tobacco stems or stalks and passing steam successively through flow through chambers containing the tobacco at temperatures of 250° F. to 300° F. to extract nicotine and other volatile constituents from the tobacco. Long expired U.S. Pat. No. 999,674, issued to J. Sartig on Aug. 1, 1911, teaches treating tobacco with ammonia for liberating nicotine and then passing steam below 212° F. continuously through the tobacco to carry off nicotine with the steam. U.S. Pat. No. 1,671,259, issued to T. Schloesing on May 28, 1928, teaches circulating a mixture of steam and ammonia through tobacco at temperatures below 212° F. to remove nicotine. U.S. Pat. No. 1,880,336 issued to A. Wenusch on Oct. 4, 1932, teaches passing heated air through tobacco until the tobacco reaches 212° F. and then passing superheated steam therethrough to reduce the nicotine in the tobacco. U.S. Pat. No. 1,984,445, issued to W. Wagner on Dec. 18, 1934, teaches removing nicotine from tobacco by passing an ammonia vapor through the tobacco, aerating the tobacco and then exposing the tobacco to acetic acid while subjecting the tobacco to an evaporation heat. U.S. Pat. No. 2,136,485, issued to F. Berka et al, on Nov. 15, 1938, teaches denicotizing tobacco by passing a mixture of air and ammonia therethrough at temperatures below 212° F. U.S. Pat. No. 4,153,063, issued to W. Roselius et al, on May 8, 1979, teaches denicotizing tobacco by passing carbon dioxide therethrough at very high pressure ranges and temperatures below 212° F.

A number of other patents, such as U.S. Pat. No. 1,671,259, issued to T. Schloesing on May 29, 1928; No. 3,151,118, issued to G. P. Moser on Sept. 29, 1964; No. 3,742,962, issued to C. Brochot on July 3, 1973; and No. 3,821,960, issued to L. Egri on July 2, 1974, teach or suggest the broad use of an ammonia source and steam at comparatively low temperature ranges below 250° F. for the purpose of denicotizing tobacco. Further, U.S. Pat. No. 3,760,815, issued to E. J. Deszyck on Sept. 25, 1973, teaches the use of an ammonia source and salts for the purpose of tobacco coherence. In addition, U.S. Pat. Nos. 3,771,533, issued to R. G. Armstrong et al on Nov. 17, 1973; No. 4,248,252, issued to A. T. Lendvay et al on Feb. 3, 1981; and No. 4,266,562, issued to H. B. Merritt et al on May 12, 1981, all suggest use of an ammonia source and $CO_2$, some even at temperatures in excess of 250° F. for purposes of puffing or expanding tobacco. In fact, flavor has been a consideration in utilizing an ammonia source for flavor enhancement of a synthetic material in U.S. Pat. Nos. 4,079,742, issued to N. B. Ranier et al on Mar. 21, 1978 and No. 4,184,495, issued to N. B. Ranier et al on Jan. 22, 1980 and in utilizing an ammonia source with a carboxylic acid as taught by U.S. Pat. No. 4,286,606, issued to J. W. Swain et al on Sept. 1, 1981. However, none of these aforenoted patents teaches or suggests the novel process of utilizing an ammonia source and steam in the manner as specifically set forth herein for forming favorable flavor compounds in a moisturized tobacco.

In the main, the past tobacco treating art has either utilized an ammonia source and steam in treating tobacco materials, the processes generally employing continuous flow through systems for the purpose of extracting nicotine from the treated tobacco or expanding the tobacco; or, the past art has utilized an ammonia source and a specifically selected organic compound when flavor has been a consideration.

In accordance with the present invention, an improved, straightforward, efficient and economical tobacco treating process is provided. The present invention recognizes the benefits, efficiency, economy and utility of treating tobacco with steam and an ammonia source, and employs these treating agents in a novel and useful manner to obtain an improved tobacco product for smoking articles, such as cigarettes, which has enhanced flavor qualities heretofore unknown in tobacco smoking articles without sacrifice of other essential and desirable tobacco product qualities or harm to the moisture qualities thereof.

Various other features of the present invention will become obvious to one skilled in the art upon reading the novel disclosure set forth herein.

SUMMARY OF THE INVENTION

More particularly, the present invention provides a tobacco treating process for forming flavor compounds in a moisturized tobacco including: introducing moisturized tobacco to be treated into a tobacco containing zone; introducing an ammonia source into the contained zone; heating the contained zone when substantially closed to bring the tobacco to a temperature in the range of approximately 250° F. to 350° F. for a sufficient time period to cause reaction of the ammonia source and reducing sugars contained in the tobacco to improve tobacco flavor compounds without substantially reducing tobacco moisture content, cooling the tobacco in the containing zone; and, removing the tobacco from the zone when cooled to a preselected level.

It is to be understood that various changes can be made by one skilled in the art in one or more of the several steps of the inventive method disclosed herein without departing from the scope or spirit of the present invention.

BRIEF DESCRIPTION OF THE DRAWINGS

Referring to the drawings which disclose one advantageous embodiment of the present invention.

DETAILED DESCRIPTION OF THE INVENTION

Figure 1:
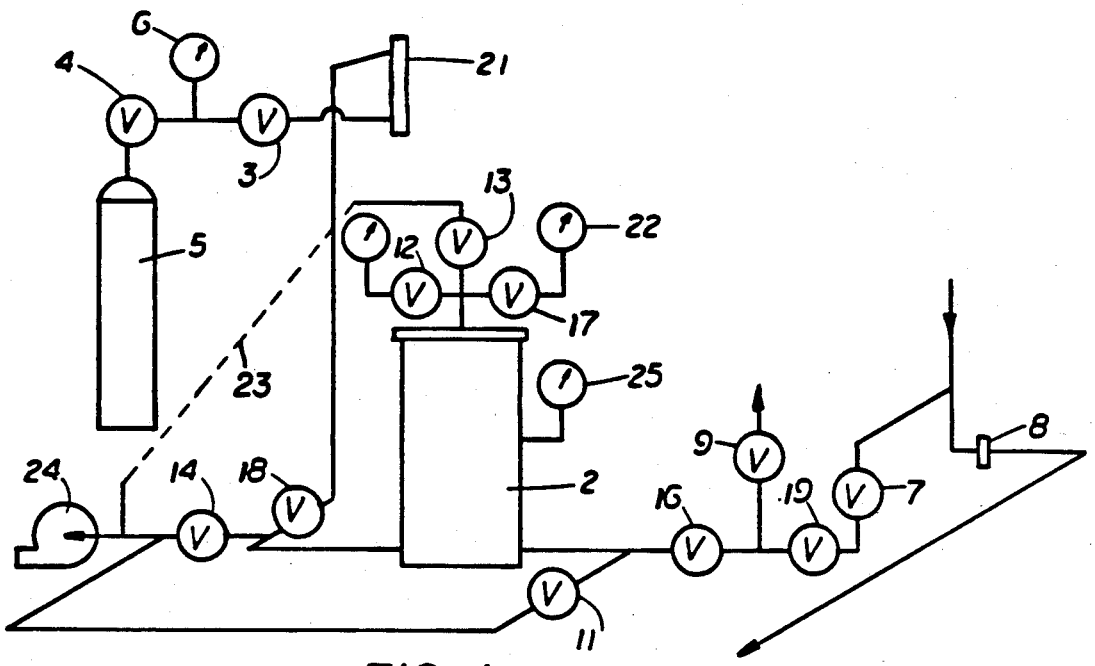
FIG. 1 is a schematic flow diagram of apparatus which can be used in carrying out the inventive process, utilizing wet heat.

Reference is made to FIG. 1 which discloses the embodiment of the inventive process utilizing a suitable ammonia source and wet heat. Tobacco to be treated which is advantageously in the moisture content weight range of 10% to 60%, is placed into a foraminous screen type flow through basket (not shown). The basket is then placed into impregnator 2 and the lid thereof sealed to prevent leakage. With valve 3 closed, primary ammonia gas valve 4 is opened. At a pressure of approximately 120 to 130 psig as shown on pressure gauge 6, ammonia gas is indicated as being available. Primary steam valve 7 is opened to allow live steam at 120 psig, which can be superheated, to be available for impregnation. It is to be noted that steam trap 8 removes unwanted condensate from the steam line so that the condensate does not flow into impregnator 2.

With valve 9, which leads to a 15" Hg vacuum source, not shown and valves 11, 12, 13, and 14 closed, valves 16 and 17 are opened. It is to be noted that valve 18 serves as a check valve to prevent backflow of gases into ammonia tank 5. Simultaneously, valves 3 and 19 are opened to allow ammonia gas and steam to flow respectively through these valves into otherwise closed impregnator 2 containing the screen basket of tobacco to be treated, the flow of ammonia gas being indicated by rotometer 21. The flow of both gases into impregnator 2 is allowed to continue until the desired pressure is in the range of 30 to 90 psig and advantageously 60 psig as indicated by pressure gauge 22. The desired temperature of the tobacco is brought to a temperature in the range of 200° F. to 300° F. as indicated by temperature gauge 25.

When the desired pressure and tobacco temperature have been reached and the tobacco has been treated for a preselected residence time in the range of 5 minutes to 24 hours, valves 3 and 19 are closed and valves 14 and 13 are opened to allow residual gas to flow out of impregnator 2 as the pressure within the impregnator returns to atmospheric and the tobacco cooled by natural convection. In this regard, it is to be noted that line 23 connects both exhaust points through valves 14 and 13 to a common exhaust blower 24 which assists in the depressurization step. After depressurization, vacuum valve 9 is open and the lid to impregnator 2 is removed. The tobacco is then removed from the screen basket and dried or reordered, as the case may be, to a final moisture content suitable for smoking article manufacture, advantageously in the range of 12% to 15% by weight. It is to be understood that in accordance with the present invention, the tobacco to be treated can be subjected to at least 15 inches of mercury vacuum by opening vacuum valve 9 for a period prior to introduction of an ammonia source into the closed zone. It is further to be understood that the ammonia source for treating the tobacco can be in the form of ammonium hydroxide introduced into impregnator 2 as a liquid, or diammonium phosphate. Further, it is to be understood, that introduction of steam and an ammonia source need not be simultaneous but can be sequential as well. As to the tobacco to be treated, it can be in any one of several forms, such as stem, leaf, reconstituted or a mixture of the same. Even further, cooling of the treated tobacco, in addition to release of gas pressure and natural convection can also be accomplished conductively through suitable mechanical cooling equipment (not shown). As a flavor enhancing additive, sugar and/or citrus pectin may be added to the tobacco prior to heating.

Figure 2:
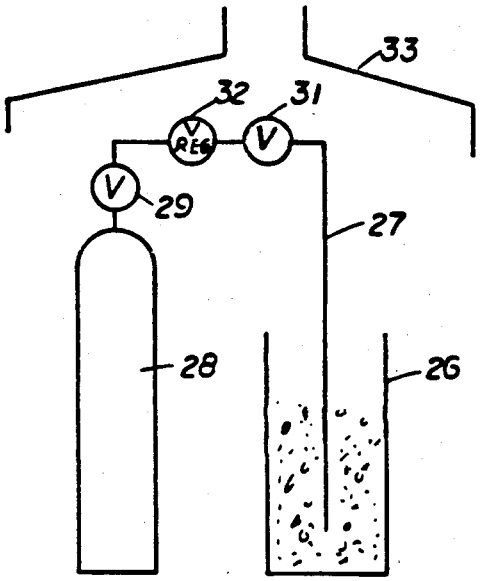
FIG. 2 is a schematic flow diagram of apparatus which can be used in carrying out the inventive process, utilizing dry heat; and, FIG. 3 is a schematic arrangement of a convection oven with a tobacco impregnator disposed therein which can be used in accordance with the process of FIG. 2, utilizing dry heat.
Figure 3:
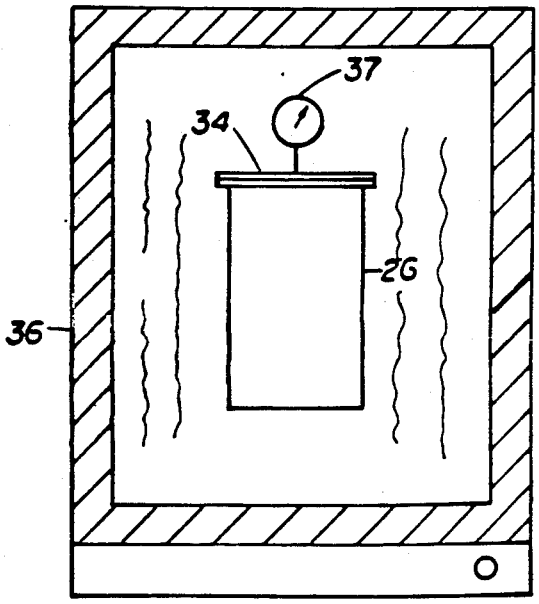

Referring to FIG. 2 and 3 which disclose a further embodiment of the inventive process utilizing a suitable ammonia source and dry heat, tobacco to be treated, which can be in any one of the several forms aforedescribed, with a percentage by weight moisture content as aforedescribed is placed into a to be closed impregnator 26. A conduit 27 is then inserted into the center of the tobacco bed. The conduit 27 is connected to a suitable ammonia source which is disclosed as an ammonia gas through valves 29 and 31 and regulator 32. With valve 31 closed, primary valve 29 is opened and regulator 32 is set at approximately 10 to 20 psig delivery pressure for ammonia gas. Valve 31 is then opened to allow the ammonia gas to flow through pipe 27 into the bed of tobacco in impregnator 26. The gas flow is allowed to continue until the air directly above the tobacco bed is saturated with ammonia. A suitable pH indicator, such as litmus paper, can be used to determine pH change with ammonia fumes being removed from the system through exhaust hood 33. The tobacco to be processed is pretreated with sugar, diammonium phosphate, or citrus pectin, or a combination thereof prior to being placed into the impregnator.

When ammonia saturation of the tobacco to be treated has been reached, valve 31 is closed, pipe or conduit 27 removed and lid 34 securely fastened at the top of impregnator 26 to prevent leakage. Impregnator 26 is then placed in convection oven 36 (FIG. 3) and heat is applied for 30 to 90 minutes to raise the tobacco to a temperature in the range of 200° to 300° F. After a suitable residence time, such as aforedescribed, the impregnator 26 is removed from the oven and cooled, either by natural convection or by suitable mechanical cooling means. It is to be noted that temperature gauge 37 permits reading of tobacco temperature. When the temperature of the tobacco reaches ambient, lid 34 is removed and the tobacco removed from the impregnator for further treatment as aforedescribed.

Set forth hereinbelow are several examples and resulting tables for each example of various tobacco treated in accordance with the inventive process and variations thereof described herein, using either the equipment of FIG. 1 or that of FIGS. 2 and 3.

EXAMPLE I

A first sample of reconstituted tobacco containing invert sugar and at a moisture content of 14% by weight was treated with a citrus pectin in a 1.25% solution of deionized water by spraying the solution onto the tobacco resulting in a tobacco having a moisture content of 50% by weight and a pectin level of 2% by weight on a bone dry basis. The tobacco was then conditioned to a moisture content of 14% by weight and was then treated with ammonia gas using the apparatus of FIGS. 2 and 3. After being treated with ammonia gas the reaction vessel was sealed and heated for 1½ hours at 300° F.

For comparison purposes, a second tobacco containing invert sugar and at a moisture content of 14% by weight was treated with ammonia gas using the apparatus of FIGS. 2 and 3. After being treated with ammonia gas the reaction vessel was sealed and heated for 1½ hours at 300° F.

It was found that cigarettes incorporating the tobacco of the first sample had less irritation and more overall taste than cigarettes incorporating the tobacco of the second sample.

EXAMPLE II

A first sample of a tobacco was treated with ammonia gas using the apparatus of FIGS. 2 and 3, and after being treated with ammonia gas the reaction vessel was sealed and heated for 1½ hours at 230° F.

A second sample of a tobacco was sprayed with a 2.5% citrus pectin solution resulting in a tobacco having a moisture content of 50% by weight and a pectin level of 2% by weight on a bone dry basis. The tobacco was then conditioned to a moisture content of 14% by weight and was then treated with ammonia gas using the apparatus of FIGS. 2 and 3. After being treated with ammonia gas the reaction vessel was sealed and heated for 1½ hours at 230° F.

A third sample of a tobacco was sprayed with a solution containing a mixture of citrus pectin, invert sugar, and diammonium phosphate resulting in a tobacco having a moisture content of 50% by weight, a pectin level of 2% by weight on a bone dry basis, a sugar level of 5% by weight on a bone dry basis, and a diammonium phosphate level of 3% by weight on a bone dry basis. The tobacco was then conditioned to a moisture content of 14% by weight and was then treated with an ammonia gas using the apparatus of FIGS. 2 and 3. After being treated with ammonia gas the reaction vessel was sealed and heated for 1½ hours at 230° F.

It was found that cigarettes incorporating the tobacco of sample 3 had less irritation and more overall flavor than the cigarettes incorporating the tobacco of the first and second samples, and the cigarettes incorporating the tobacco of sample 2 had less irritation and more overall flavor than cigarettes incorporating the tobacco of sample 1.

EXAMPLE III

A first sample of a tobacco was treated with a solution containing 3% pectin and 6.5% diammonium phosphate by spraying the solution on the tobacco resulting in a tobacco having a moisture content of 35% by weight, a pectin level of 4% by weight on a bone dry basis, and a diammonium phosphate level of 8.5% by weight on a bone dry basis. This tobacco was then conditioned to a moisture level of 14% by weight and placed in the apparatus of FIG. 3.

A second sample of a tobacco was treated with a solution containing 3% pectin and 6.5% diammonium phosphate by spraying the solution on the tobacco resulting in a tobacco having a moisture content of 35% by weight, a pectin level of 4% by weight on a bone dry basis, and a diammonium phosphate level of 8.5% by weight on a bone dry basis. This tobacco was then placed in the apparatus of FIG. 3 and heated for 1½ hours at 300° F. The tobacco was then removed from the apparatus and reconditioned to a moisture content of 14% by weight.

It was found that cigarette incorporating the tobacco of sample 2 had less irritation than cigarettes incorporating the tobacco of sample 1.

EXAMPLE IV

A first sample of a tobacco was treated with a solution containing 3.2% pectin and 4.8% diammonium phosphate by spraying the solution on the tobacco resulting in a tobacco having a moisture content in the range of 36 to 40% by weight, a pectin level of 2% by weight on a bone dry basis, and an ammonium phosphate level of 3% by weight on a bone dry basis. The tobacco was then treated with ammonia gas using the apparatus of FIGS. 2 and 3. After being treated with ammonia gas the reaction vessel was sealed and heated for 1½ hours at 300° F. The ammonia gas treated tobacco was removed from the reaction vessel and reconditioned to a moisture content of 14% by weight.

A second sample of tobacco was treated with a solution containing 3.2% pectin and 4.8% diammonium phosphate by spraying the solution on the tobacco resulting in a tobacco having a moisture content in the range of 36% to 40% by weight, a pectin level of 2% by weight on a bone dry basis, and a diammonium phosphate level of 3% by weight on a bone dry basis. The tobacco was then treated with ammonia gas using the apparatus of FIGS. 2 and 3. After being treated with ammonia gas the reaction vessel was sealed and heated for 1½ hours at 200° F. The ammonia gas treated tobacco was removed from the reaction vessel and reconditioned to a moisture content of 14% by weight. This reconditioned tobacco was then reverted to a moisture content of 30% by weight, then dried to a moisture content of 3% by weight, and finally reordered to a moisture content of 14% by weight.

It was found that cigarettes incorporating the tobacco of the second sample had less irritation and more flavor than the tobacco of the first sample.

What is claimed is:

1. A process of forming favorable flavor compounds in a moisturized tobacco comprising:
   - contacting tobacco with a pectin solution resulting in a tobacco having a pectin level of a predetermined percentage by weight on a bone dry basis and a moisture content of greater than 14% by weight;
   - reconditioning the resulting tobacco to a moisture content of about 14% by weight;
   - introducing the resulting tobacco to be treated into a tobacco containing zone;
   - introducing an ammonia source into said tobacco containing zone;
   - heating the tobacco containing zone when said zone is closed to bring the temperature of the tobacco introduced into said zone to a temperature in the range of approximately 200° F. to 300° F. for a sufficient time period to cause reaction of the ammonia source, pectin, and reducing sugars in the tobacco without substantially reducing the moisture content of the tobacco to improve the tobacco flavor compounds;
   - cooling the tobacco in the containing zone to a lower preselected temperature level; and,
   - removing the treated tobacco from the containing zone.

2. The process of claim 1, wherein:
   - the tobacco has a moisture content of about 14% by weight prior to being contacted with the pectin solution.

3. The process of claim 1, wherein the pectin level of the tobacco resulting from contacting the tobacco with the pectin solution is about 2% by weight pectin on a bone dry basis.

4. The process of claim 1, wherein the moisture content of the tobacco resulting from contact with the pectin solution is about 50% by weight.

5. The process of claim 1, wherein the tobacco containing zone is heated for approximately 1½ hours.

6. A process of forming favorable flavor compounds in a moisturized tobacco comprising:

contacting tobacco with a solution containing citrus pectin, invert sugar, and diammonium phosphate resulting in a tobacco having a pectin level, invert sugar level, and diammonium phosphate level of predetermined percentages by weight on a bone dry basis and a moisture content of greater than 14% by weight;

reconditioning the resulting tobacco to a moisture content of about 14% by weight;

introducing the tobacco to be treated into a tobacco containing zone;

heating said tobacco containing zone when said zone is closed to bring the temperature of the tobacco introduced into said zone to a temperature of the tobacco introduced into said zone to a temperature of about 230° F. for a sufficient time period for the diammonium phosphate to disassociate liberating free ammonia, and also to cause reaction of the ammonia, pectin, reducing sugars in the tobacco, invert sugar, and disassociated phosphate without substantially reducing the moisture content of the tobacco to improve the tobacco flavor compounds;

cooling the tobacco in the containing zone to a lower preselected temperature level; and, removing the treated tobacco from the containing zone.

7. The process of claim 6, wherein the tobacco has a moisture content of about 14% by weight prior to being contacted with the solution.

8. The process of claim 6, wherein the tobacco resulting from contacting the tobacco with the solution has a pectin level of about 2% by weight on a bone dry basis, an invert sugar level of about 5% by weight on a bone dry basis, and a diammonia phosphate level of about 3% by weight on a bone dry basis.

9. The process of claim 6, wherein the moisture content of the tobacco resulting from contact with the solution is about 50% by weight.

10. The process of claim 6, wherein the tobacco containing zone is heated for approximately 1½ hours.

11. A process of forming favorable flavor compounds in a moisturized tobacco comprising:

contacting tobacco with a solution containing citrus pectin and diammonium phosphate resulting in a tobacco having a pectin level, and diammonium phosphate level of predetermined percentages by weight on a bone dry basis and a moisture content of greater than 14% by weight;

introducing the tobacco to be treated into a tobacco treating zone;

heating the tobacco containing zone when said zone is closed to bring the temperature of the tobacco introduced into said zone to a sufficient temperature and for a sufficient period of time for the diammonium phosphate to disassociate liberating free ammonia and also to cause reaction of the ammonia, citrus pectin, disassociated phosphate and sugar in the tobacco without substantially reducing the moisture content of the tobacco to improve the tobacco flavor compounds;

cooling the tobacco in the containing zone to a lower preselected temperature; and removing the treated tobacco from the containing zone.

12. The process of claim 11, wherein the tobacco has a moisture content of about 35% to 50% by weight prior to being contacted with the solution.

13. The process of claim 11, wherein the tobacco resulting from contacting the tobacco with the solution has a pectin level in the range of about 2% to 4% by weight on a bone dry basis and a diammonium phosphate level in the range of about 3% to 10% by weight on a bone dry basis.

14. The process of claim 11, wherein the moisture content of the tobacco resulting from contact with the solution is about 35% by weight.

15. The process of claim 11, wherein the tobacco containing zone is heated to a temperature of about 300° F.

16. The process of claim 11, wherein the tobacco containing zone is heated for approximately 1½ hours.

17. A process for forming favorable flavor compounds in a moisturized tobacco comprising:

contacting tobacco with a solution containing citrus pectin and diammonium phosphate resulting in a tobacco having a pectin level, and diammonium phosphate level of predetermined percentages by weight on a bone dry basis and a moisture content of greater than 14% by weight;

introducing an ammonia source into said tobacco containing zone;

heating said tobacco containing zone when said zone is closed to bring the temperature of the tobacco introduced into said zone to a sufficient temperature and for a sufficient period of time for the diammonium phosphate to disassociate liberating free ammonia, and also to cause reaction of the ammonia, citrus pectin, disassociated phosphate, and sugar in the tobacco without substantially reducing the moisture content of the tobacco to improve the tobacco flavor compounds;

cooling the tobacco in the containing zone to a lower preselected temperature; and, removing the treated tobacco from the containing zone.

18. The process of claim 17, wherein the tobacco has a moisture content of about 14% by weight prior to being contacted by the solution.

19. The process of claim 17, wherein the tobacco resulting from contacting the tobacco with the solution has a pectin level of about 2% by weight on a bone dry basis and a diammonium phosphate level of about 3% by weight on a bone dry basis.

20. The process of claim 17, wherein the moisture content of the tobacco resulting from contact with the solution is within the range of about 36% to 40% by weight.

21. The process of claim 17, wherein the tobacco containing zone is heated to a temperature within the range of about 200° F. to 300° F.

22. The process of claim 17, wherein the tobacco containing zone is heated for approximately 1½ hours.

23. The process of claim 17, wherein after the treated tobacco is removed from the tobacco containing zone the tobacco is reconditioned to a moisture content of about 14% by weight.

24. The process of claim 23, wherein after the tobacco is reconditioned to a moisture content of 14% by weight, the tobacco is reordered to a moisture content of about 30% by weight, and then reconditioned back to a moisture content of about 14% by weight.

* * * * *